US011136804B2

(12) United States Patent
Rupp et al.

(10) Patent No.: US 11,136,804 B2
(45) Date of Patent: Oct. 5, 2021

(54) RAIL ASSEMBLY FOR FURNITURE PARTS

(71) Applicant: Julius Blum GmbH, Hoechst (AT)

(72) Inventors: Matthias Rupp, Hohenweiler (AT); Christian Hauer, Hoerbranz (AT); Hermann Haemmerle, Lustenau (AT); Ingo Gasser, Hoechst (AT); Franz Kohlweiss, Hard (AT)

(73) Assignee: Julius Blum GmbH, Hoechst (AT)

( * ) Notice: Subject to any disclaimer, the term of this patent is extended or adjusted under 35 U.S.C. 154(b) by 165 days.

(21) Appl. No.: 16/442,685

(22) Filed: Jun. 17, 2019

(65) Prior Publication Data

US 2019/0301216 A1 Oct. 3, 2019

Related U.S. Application Data

(63) Continuation of application No. PCT/AT2018/060005, filed on Jan. 8, 2018.

(30) Foreign Application Priority Data

Jan. 13, 2017 (AT) ..... A 50020/2017

(51) Int. Cl.
*E05D 15/26* (2006.01)
*E05F 5/00* (2017.01)
(Continued)

(52) U.S. Cl.
CPC ..... *E05D 15/26* (2013.01); *E05D 15/264* (2013.01); *E05D 15/58* (2013.01); *E05F 1/08* (2013.01);
(Continued)

(58) Field of Classification Search
CPC . E05D 15/58; E05D 15/264; E05Y 2900/212; E05Y 2900/20
See application file for complete search history.

(56) References Cited

U.S. PATENT DOCUMENTS 2,669,499 A * 2/1954 Vanderplank ..... E05D 15/58 312/322
2,936,206 A * 5/1960 Wilmer ..... E06B 3/5045 312/322
(Continued)

FOREIGN PATENT DOCUMENTS

DE 24 04 874 8/1975
DE 43 08 196 10/1993
(Continued)

OTHER PUBLICATIONS

International Search Report dated Apr. 9, 2018 in International (PCT) Application No. PCT/AT2018/060005.
(Continued)

*Primary Examiner* — Victor D Batson
*Assistant Examiner* — Matthew J Sullivan
(74) *Attorney, Agent, or Firm* — Wenderoth, Lind & Ponack, L.L.P.

(57) ABSTRACT

A guide system is hingedly connected to a second furniture part, and has a rail arrangement including a guide rail having a longitudinal direction for guiding the furniture parts, and a carrier movably mounted transversely to the longitudinal direction of the guide rail. The carrier can be moved into a transfer position in which the carrier adjoins the guide rail in the longitudinal direction such that a guiding device to be connected to one of the furniture parts and movable along the guide rail can be transferred to and from between the guide rail and the carrier. The guide system includes a column connected to the carrier, the column being arranged vertically, and can be moved together with the carrier transversely to the longitudinal direction of the guide rail. The first furniture part is connected to the guiding device, and the second furniture part is movably connected to the column.

18 Claims, 12 Drawing Sheets

(51) Int. Cl.
*E05D 15/58* (2006.01)
*E05F 1/08* (2006.01)
*E05F 1/16* (2006.01)

(52) U.S. Cl.
CPC ..... *E05F 5/00* (2013.01); *E05F 5/003* (2013.01); *E05F 1/16* (2013.01); *E05Y 2201/638* (2013.01); *E05Y 2800/24* (2013.01); *E05Y 2900/20* (2013.01); *E05Y 2900/212* (2013.01)

(56) References Cited

U.S. PATENT DOCUMENTS

| | | | | |
|---|---|---|---|---|
| 3,456,995 | A * | 7/1969 | Nyquist | E05D 15/58 312/322 |
| RE28,994 | E * | 10/1976 | Aylworth | E06B 3/5045 312/245 |
| 4,729,612 | A * | 3/1988 | Stone | E05D 15/58 312/109 |
| 5,131,449 | A | 7/1992 | Winn et al. | |
| 7,987,555 | B2 * | 8/2011 | Chen | E05F 5/02 16/286 |
| 8,231,187 | B2 * | 7/2012 | Hoffman | E05D 15/58 312/322 |
| 8,484,895 | B2 * | 7/2013 | Kuhnmuench | E05D 15/581 49/164 |
| 8,756,865 | B2 * | 6/2014 | Nicholson | E05D 15/58 49/180 |
| 10,227,806 | B2 * | 3/2019 | Gabl | E06B 3/5045 |
| 10,676,974 | B2 * | 6/2020 | Wojdyla | E05D 15/58 |
| 10,876,340 | B2 * | 12/2020 | Rupp | E05D 15/58 |
| 2015/0300075 | A1 * | 10/2015 | Lyons | E06B 3/509 312/311 |
| 2017/0241178 | A1 | 8/2017 | Gabl | |
| 2017/0260789 | A1 * | 9/2017 | Gabl | E06B 3/509 |
| 2019/0284859 | A1 * | 9/2019 | Rupp | E05D 15/264 |
| 2019/0301216 | A1 * | 10/2019 | Rupp | E05F 1/08 |
| 2019/0301218 | A1 * | 10/2019 | Rupp | E05F 1/08 |
| 2019/0330897 | A1 * | 10/2019 | Rupp | E05D 15/58 |
| 2019/0330898 | A1 * | 10/2019 | Rupp | E05D 15/0665 |
| 2020/0018106 | A1 * | 1/2020 | Rupp | E05D 15/0634 |
| 2020/0018107 | A1 * | 1/2020 | Rupp | E05F 3/14 |
| 2020/0018108 | A1 * | 1/2020 | Sperger | E05D 15/58 |
| 2020/0063480 | A1 * | 2/2020 | Gasser | E05D 7/0423 |
| 2020/0063482 | A1 * | 2/2020 | Kohlweiss | E05F 1/1253 |
| 2020/0199925 | A1 * | 6/2020 | Vander Bent, Jr. | E05D 15/36 |
| 2020/0217124 | A1 * | 7/2020 | Bernhagen | E05D 15/58 |
| 2020/0347656 | A1 * | 11/2020 | Groninga | B64C 27/04 |
| 2020/0386028 | A1 * | 12/2020 | Girotto | E05F 15/56 |

FOREIGN PATENT DOCUMENTS

| | | |
|---|---|---|
| DE | 297 10 854 | 9/1997 |
| EP | 0 433 726 | 6/1991 |
| JP | 5841894 | 3/1983 |
| WO | 2016/081961 | 6/2016 |
| WO | 2016/081963 | 6/2016 |

OTHER PUBLICATIONS

Search Report issued with Taiwanese Office Action dated Jan. 29, 2019 in Taiwanese Application No. 107101181.

* cited by examiner

RAIL ASSEMBLY FOR FURNITURE PARTS

BACKGROUND OF THE INVENTION

The present invention relates to a guide system for guiding a movably-supported first furniture part, in particular a first door wing of a folding door, which is hingedly connected to a second furniture part, in particular a second door wing of a folding door, and with a rail arrangement. The rail arrangement includes a guide rail having a longitudinal direction for guiding the furniture parts, and a carrier movably mounted in a direction transverse to the longitudinal direction of the guide rail. The carrier, in a mounting position, can be moved into a transfer position in which the carrier adjoins the guide rail in the longitudinal direction such that a guiding device configured to be connected to one of the furniture parts and configured to be movable along the guide rail can be transferred to and from between the guide rail and the carrier. The invention further concerns an item of furniture comprising such a guide system.

EP 0 433 726 B1 shows a rail arrangement for guiding cabinet doors which, in a mounting position, are hingedly connected to one another by a vertically extending pivoting axis. By the rail arrangement, the cabinet doors are movably mounted between a first position, in which the cabinet doors are aligned coplanar to one another, and a second position, in which the cabinet doors are aligned parallel to one another, and the cabinet doors are accommodated in the second position in a lateral insertion gap. The rail arrangement includes a first guide rail extending parallel to a front side of the cabinet, and a second guide rail arranged at a right angle relative to the first guide rail. Moreover, a carrier is provided (reference number 5 in FIG. 1) on which a first cabinet door is hingedly supported and which is configured to be displaced via guide rails in a horizontal direction and in a direction parallel to an outer wall of the cabinet, so that the two cabinet doors can be pushed into the insertion gap. A guide element (reference number 7) is arranged on the second cabinet door, the guide element being displaceably arranged along the first guide rail. A drawback with this construction is the fact that the guide element, upon the right-angled transition between the first and second guide rail, collides with the U-shaped limbs of the guide rails, and, as a result, an insertion movement of the guide element into the guide rails is impeded.

DE 24 04 874 A1 shows a room partition wall having a plurality of wall elements configured to be moved along a guide rail by running carriages. When the wall elements are no longer used for partitioning, the wall elements can be packaged within a storage room. For this purpose, the storage room includes a plurality of rail portions configured to be moved along transverse carriers. Each wall element is assigned to such a rail portion, and the rail portions can alternatively be positioned in a position being flush with the guide rail. As a result, a transfer of the wall elements from the guide rail to the rail portions is enabled. Accordingly, the wall elements, when not in use, are each transferred individually to the different rail portions, and the wall elements can be moved into the storage room in parallel positions lying behind one another. A drawback is the increased construction effort and the large space requirement, because the breadth of the storage room needs to be larger than the breadth of the wall elements.

It is an object of the present invention to provide a guide system mentioned in the introductory part, thereby avoiding the above-discussed drawbacks.

SUMMARY OF THE INVENTION

According to the invention, the guide system includes a column connected to the carrier, the column being arranged vertically in the mounting position and being configured to be moved, together with the carrier, in the direction extending transversely to the longitudinal direction of the guide rail. The first furniture part, in the mounting position, is connected to the guiding device, and the second furniture part, in the mounting position, is movably connected to the column.

In other words, the carrier adjoins the guide rail in such a way that the guiding device connected to one of the furniture parts is configured to run into or onto the carrier. The carrier, after the guiding device has been moved into or onto the carrier, can be moved—together with the guiding device—in a direction extending transversely to the longitudinal direction of the guide rail. On the contrary, when the carrier, together with the guiding device, is located in a position remote from the guide rail, the carrier can also be moved into the transfer position, so that the guiding device can be again moved back from the carrier to the guide rail. Accordingly, the carrier is configured so as to be independent from the guide rail and is located, in the transfer position, preferably at the same height as the guide rail, so that the guiding device can be transferred between the guide rail and the carrier without performing a vertical movement. Alternatively, it is possible that the guiding device can be moved to and from between the guide rail and the carrier via a height compensating device, for example by at least one inclined ramp.

According to an embodiment, a drive device with an entrainment member can be provided, and the entrainment member is acted upon by at least one force storage member and can be releasably coupled to the guiding device. The entrainment member, in the transfer position of the carrier, is locked, so that a movement of the entrainment member in the direction transverse to the longitudinal direction of the guide rail is prevented. The entrainment member can be unlocked by an entering movement of the guiding device in or on the carrier, so that the entrainment member, together with the guiding device coupled therewith, can be retracted by a force of the at least one force storage member at least over a region in the direction extending transversely to the longitudinal direction of the guide rail, preferably along a second guide rail extending transversely to the first guide rail. The drive device can be configured so as to operate exclusively mechanically, i.e. without electrical drives and without other electrical components.

BRIEF DESCRIPTION OF DRAWINGS

Further details and advantages of the present invention will be explained with the aid of the following description of figures, in which.

DETAILED DESCRIPTION OF THE INVENTION

Figure 1A:
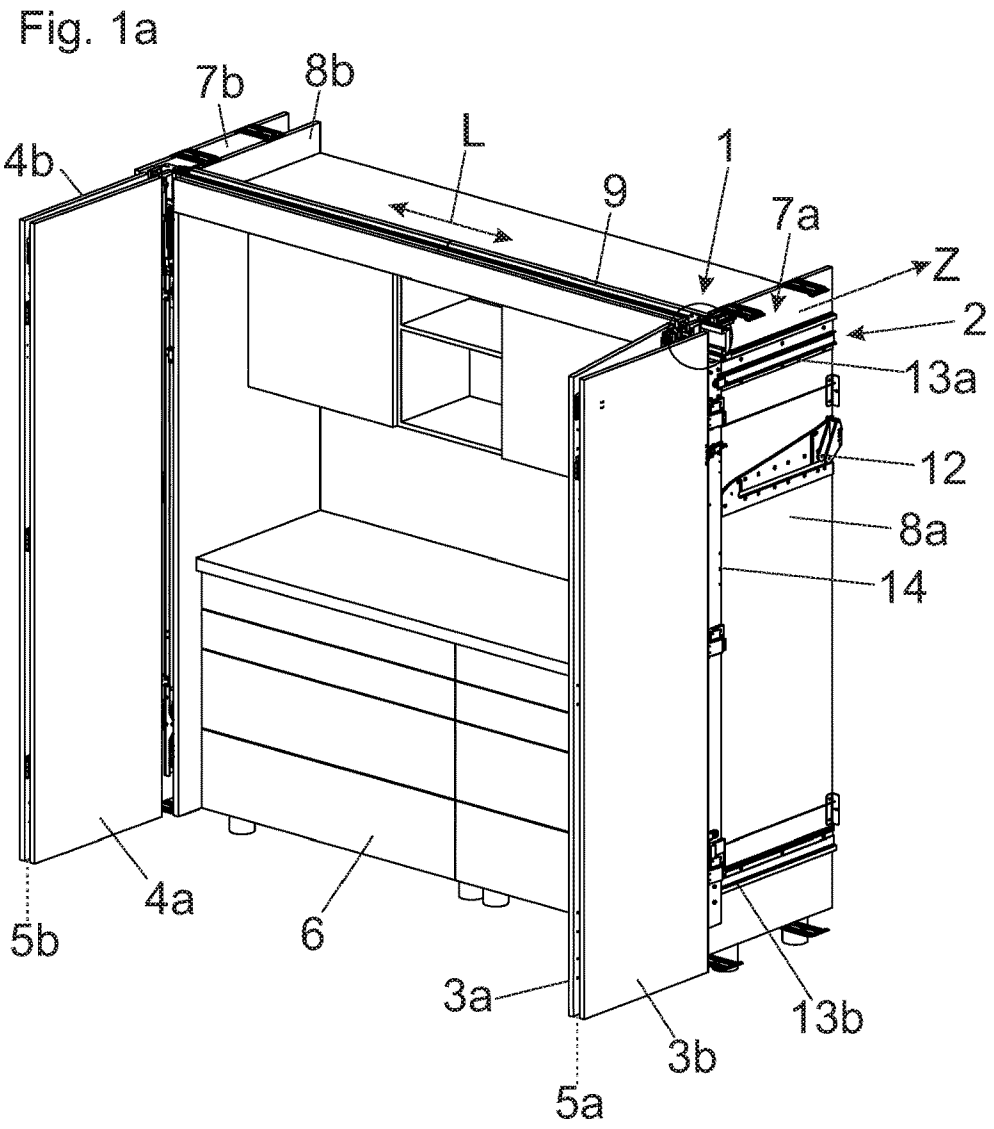
FIG. 1*a*, 1*b* are a perspective view of a guide system for moving furniture parts hingedly connected to one another, and an enlarged detail view thereof.

FIG. 1 a shows a possible application of a guide system 2 having a rail arrangement 1 for guiding a first furniture part 3*a*, preferably in the form of a first door wing of a folding door. The first furniture part 3*a* is hingedly connected to a second furniture part 3*b* in the form of a second door wing by a vertically extending axis 5*a* in the mounting position. Optionally, at least two further furniture parts 4*a*, 4*b* may be provided, and the furniture parts 4*a*, 4*b* are also pivotally connected to one another by a vertically extending axis 5*b*. The guide system 2 may be used, for example, as a room partitioning system, so that in a living area, a furniture carcass 6 as shown in FIG. 1*a* in the form of a kitchen block, an office niche, a storage room, a shelf, etc. may entirely be covered by the furniture parts 3*a*, 3*b*; 4*a*, 4*b* and, as a result, can be optically separated from the remaining space of the living area. However, the guide system 2 may also be used for cabinet systems, for example a walk-in closet. The functionality will be explained in the following with the aid of the furniture parts 3*a* and 3*b*, and the same applies to the furniture parts 4*a*, 4*b*.

The furniture parts 3*a*, 3*b* are movably supported by the guide system 2 between a first position, in which the furniture parts 3*a*, 3*b* are aligned substantially coplanar to one another and thereby cover the furniture carcass 6, and a second position, in which the furniture parts 3*a*, 3*b* are aligned parallel to one another. In the second position, the furniture carcass 6 is freely accessible for a person, and the two furniture parts 3*a*, 3*b* can be accommodated in a space-saving manner within an insertion compartment 7*a* arranged laterally besides the side wall 8*a* (the left insertion compartment 7*b* provided for the other furniture parts 4*a*, 4*b* is better visible in the drawing).

The rail arrangement 1 includes a first guide rail 9 having a longitudinal direction (L) for guiding the furniture parts 3*a*, 3*b*. For example, the first guide rail 9 can be fixed to a ceiling of a room, to a wall of a room or also to a furniture carcass 6, preferably parallel to a front side of the furniture carcass 6.

Figure 1B:
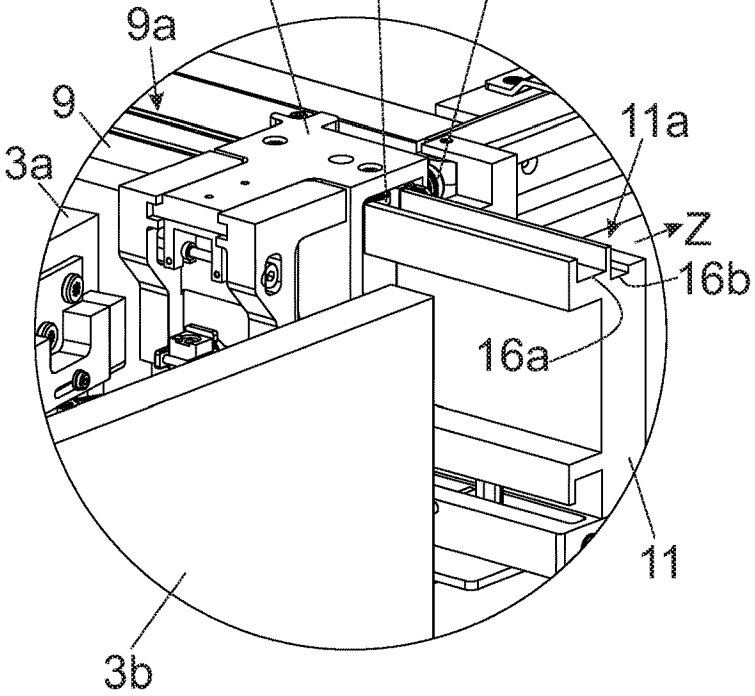

FIG. 1*b* shows the encircled region of FIG. 1*a* is an enlarged view. The first furniture part 3*a* is connected to a guiding device 10 by which the furniture parts 3*a*, 3*b* are movably supported along the first guide rail 9. Visible is a carrier 11 configured to be separate from the first guide rail 9. The carrier 11 is in the form of a displaceable slider which, in a transfer position, adjoins the first guide rail 9 in a longitudinal direction (L) such that the guiding device 10 connected to the first furniture part 3*a* can be transferred to and from between the first guide rail 9 and the carrier 11. The guiding device 10 can have at least one first running wheel 15*a* with a vertical rotational axis for receiving lateral forces, and at least one second running wheel 15*b* with a horizontal rotational axis for receiving vertical forces, and the running wheels 15*a*, 15*b* are configured to run along a profiled section 9*a* of the first guide rail 9, and the profiled section 9*a* extends in the longitudinal direction (L). The carrier 11 also includes a profiled section 11*a* having a cross-section corresponding with a form and size of the profiled section 9*a* in a cross-sectional view, so that the guiding device 10 can be transferred to and from between the first guide rail 9 and the carrier 11. For example, the carrier 11 can have at least two guide channels 16*a*, 16*b* extending the longitudinal direction (L) for guiding the running wheels 15*a*, 15*b*.

The guiding device 10 configured to be linearly displaced along the first guide rail 9 is still located, in the shown transfer position of the carrier 11, on the first guide rail 9. The carrier 11, in the transfer position, is configured to be releasably locked to the first guide rail 9, for example by a locking device 30 (FIG. 7*a*, 7*b*), and that locking can be released by a movement of the guiding device 10 in or on the carrier 11. After the carrier 11 has been unlocked, the carrier 11 can be moved—together with the guiding device 10 and the two furniture parts 3*a*, 3*b*—horizontally in a direction (Z) extending transversely, preferably at a right angle, to the longitudinal direction (L) of the first guide rail 9. The carrier 11 is connected to a vertically extending column 14 which is configured to be moved in the direction (Z) and which can be driven at least over a region in the direction (Z) by a drive device 12. The column 14 is movably supported in the direction (Z) along second guide rails 13*a*, 13*b* which, in the mounted condition, are spaced from the first guide rail 9 in a height direction.

Figure 2B:
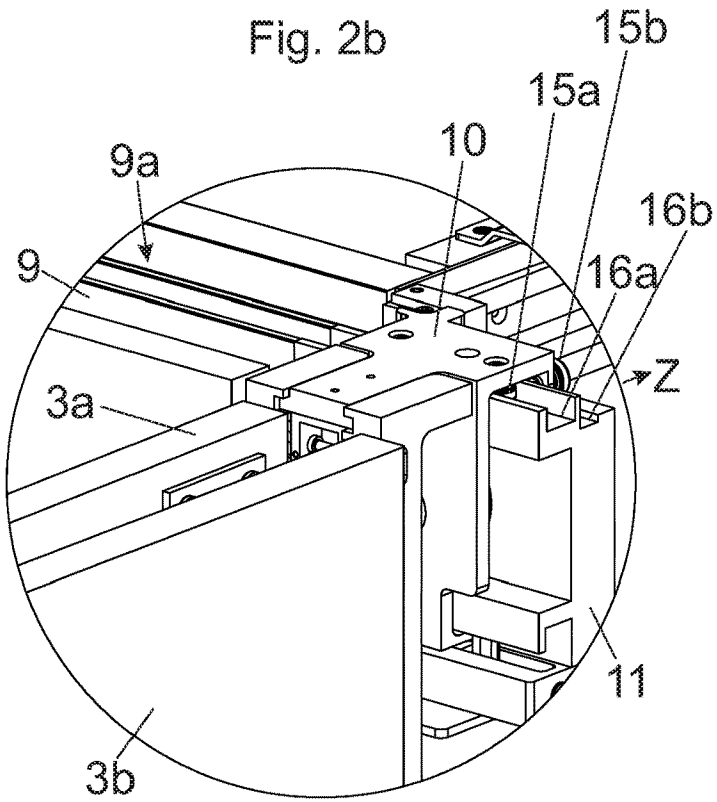
FIG. 2*a*, 2*b* show the guiding device located on the carrier, and an enlarged detail view thereof.
Figure 2A:
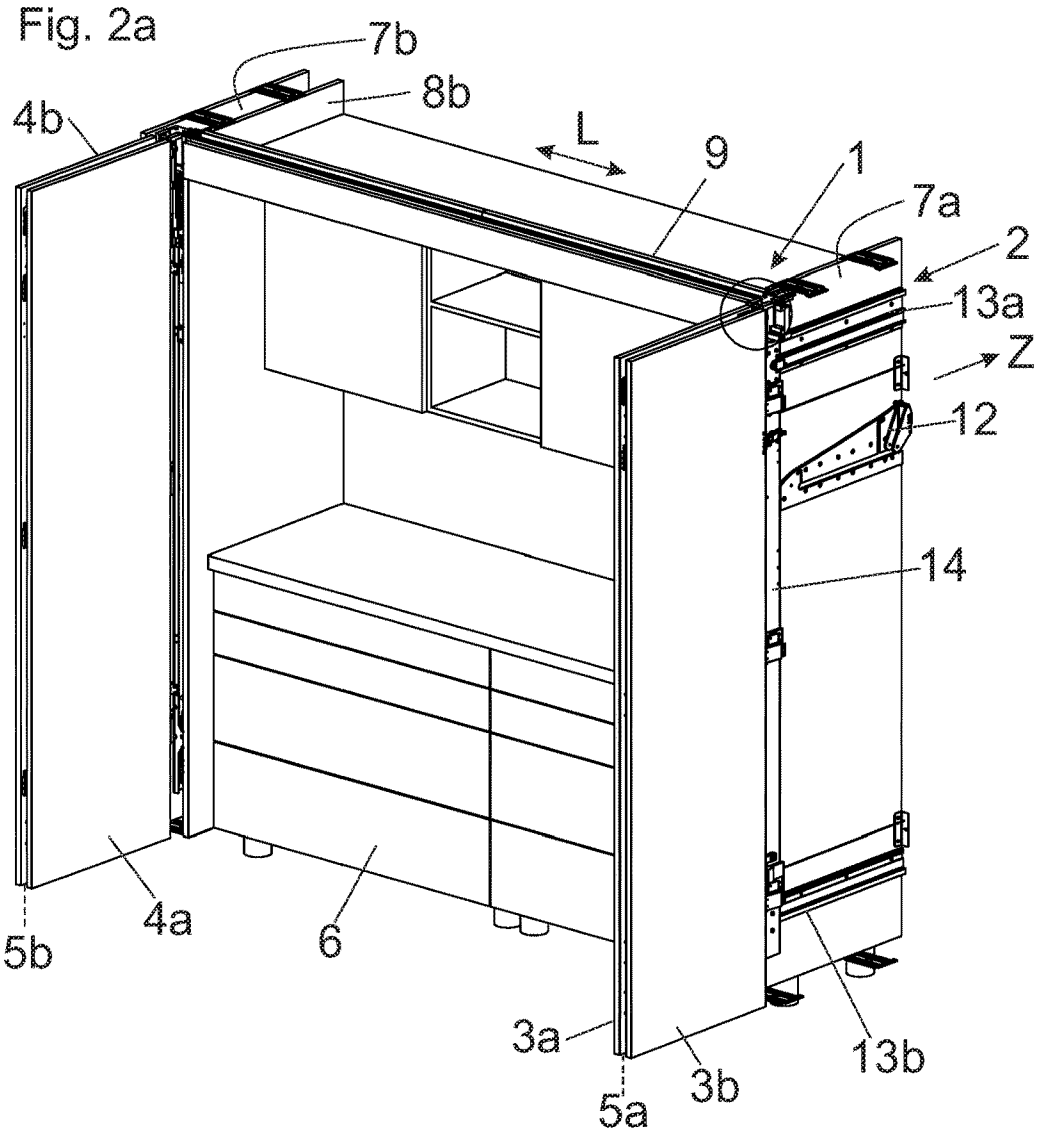

FIG. 2*a* shows the furniture parts 3*a* and 3*b*, after having been pivoted to one another starting from FIG. 1*a* about the vertical axis 5*a* and now adopt substantially a parallel position to one another. FIG. 2*b* shows the encircled region of FIG. 2*a* in an enlarged view, in which the guiding device 10 is now located on the carrier 11 being in the transfer position. A length of the carrier 11 measured in a longitudinal direction (L) can be greater than a width of the guiding device 10 measured in the longitudinal direction (L). The profiled section 9*a* of the first guide rail 9 and the profiled section 11*a* of the carrier 11 are configured so as to be identical in a cross-sectional view and are aligned flush to one another in the transfer position, so that the running wheels 15*a*, 15*b* of the guiding device 10 can be moved between the first guide rail 9 and the carrier 11 without a disturbing abutting edge. Starting from the position shown in FIG. 2*b*, the carrier 11, together with the guiding device 10 (and therewith the furniture parts 3*a*, 3*b*) can be driven by the drive device 12 at least over a region in the direction (Z).

Figure 3A:
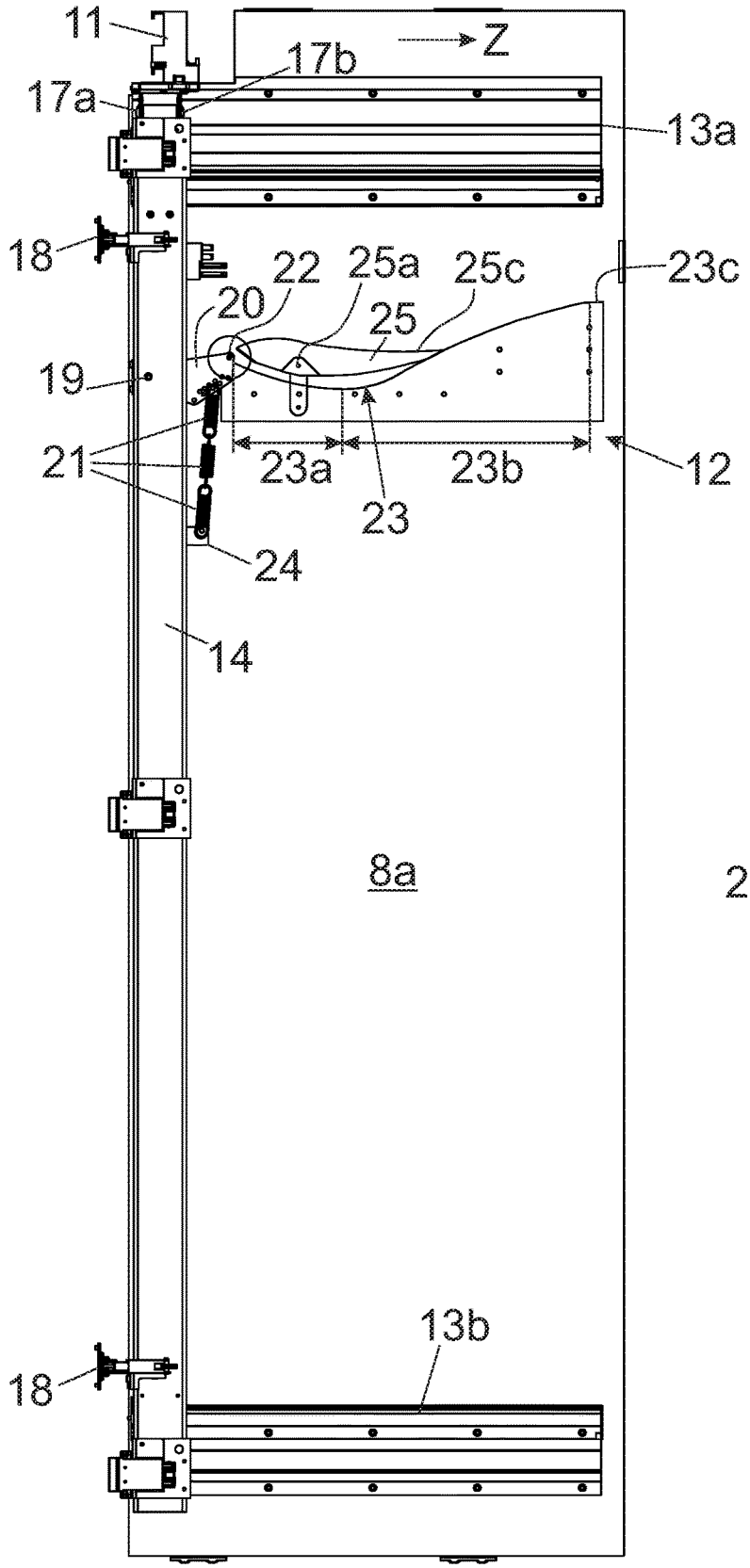
FIG. 3*a*, 3*b* show a side view of the guide system, and an enlarged detail view thereof.

FIG. 3*a* shows a side view of the carrier 11 located in the transfer position, the carrier 11 is connected to the vertically extending column 14. The column 14, together with the carrier 11, is displaceable in the direction (Z)—for example by supporting rollers 17*a*, 17*b*—along the second guide rails 13*a*, 13*b* fixed to the side wall 8*a*. Arranged on the column 14 is at least one fitting portion 18 for the movable support of the furniture part 3*b*, and a bearing portion 24 being arranged stationarily relative to the column 14. At least one, preferably a plurality of, force storage member(s) 21 of the drive device 12 for retracting the furniture parts 3*a*, 3*b* in the direction (Z) is or are anchored to the bearing portion 24.

Figure 3B:
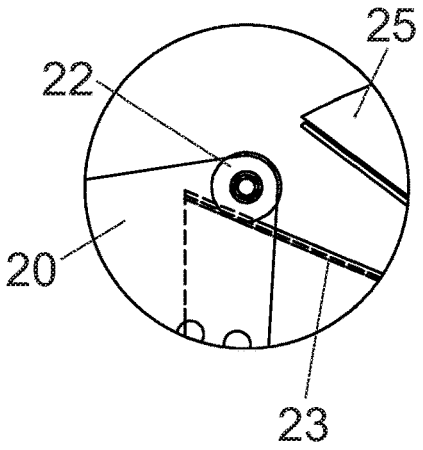

The force storage members 21, in the shown figure, are each configured as tension springs engaging on an entrainment member 20 which is pivotally mounted about a pivoting axis 19 on the column 14. A pressure roller 22 is pivotally arranged on the entrainment member 20, the pressure roller 22 can be pressed against a concave-shaped control curve 23 of the drive device 12 and can be displaced along the control curve 23 in the direction (Z) upon a movement of the column 14. The control curve 23 includes a retraction section 23*a* for partially retracting the carrier 11 in the direction (Z), and a tensioning section 23*b* adjoining the retraction section 23*a* for loading the force storage members 21. In FIG. 3*a*, the force storage members 21 are in a tensioned condition, so that the column 14 (and therewith the carrier 11), after unlocking of the carrier 11, can be retracted from the first guide rail 9 along the retraction section 23*a* by a force of the discharging force storage members 21 towards the lowest region of the control curve 23. In this way, the furniture parts 3*a*, 3*b* are also partially retracted into the insertion compartment 7*a*, whereby the furniture parts 3*a*, 3*b* are advantageously prepositioned for a continued movement into the insertion compartment 7*a* in the direction (Z). By a subsequent manual application of pressure to the furniture parts 3*a*, 3*b* aligned parallel to one another, in the region of the pivoting axis 5*a*, the column 14 (and therewith the pressure roller 22) are further moved in the direction (Z) along the tensioning section 23*b* of the control curve 23, whereby the force storage members 21 are again loaded. When the pressure roller 22 of the entrainment member 20 reaches the end section 23*c* of the control curve 23, the force storage members 21 are fully loaded, so that the furniture parts 3*a*, 3*b* can be moved starting from a position, in which the furniture parts 3*a*, 3*b* are fully inserted into the insertion compartment 7*a*, at least partially in a direction opposite the direction (Z) by the force storage members 21 upon an exit movement. Moreover, a movably-mounted switch member 25 with a setting contour 25*c* is provided. The switch member 25 is configured to be tilted about a pivoting axis 25*a*. The pressure roller 22 can be displaced, starting from the aforesaid inserted position, along the setting contour 25*c* of the switch member 25 upon a movement opposite the direction (Z). As a result, the pressure roller 22 pressurized by the force storage members 21 does not need to overcome the hindering retraction section 23*a* of the control curve 23 upon a movement in a direction opposite the direction (Z), so that the retraction section 23*a* can be bypassed by the pressure roller 22 and a force of the force storage members 21 can be maintained over a longer displacement path. FIG. 3*b* shows the region encircled in FIG. 3*a* in an enlarged view.

Figure 4A:
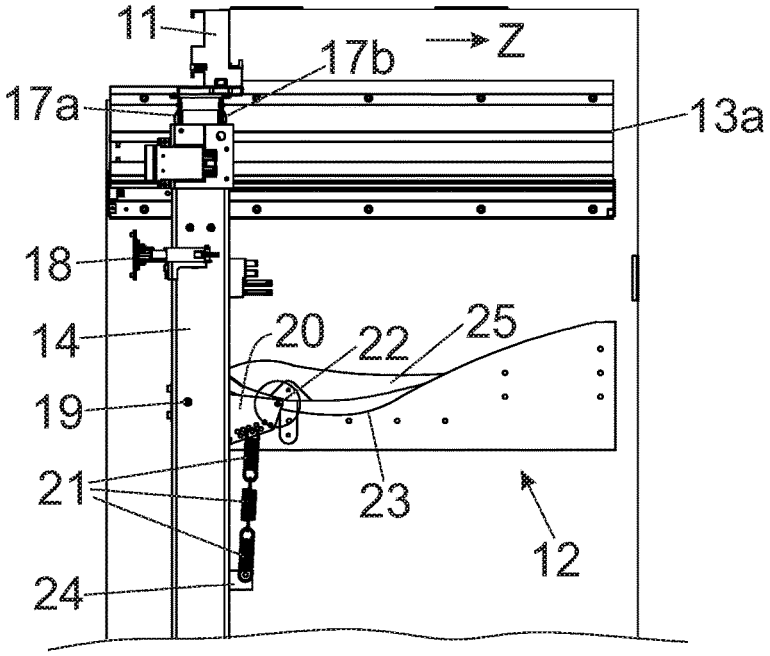
FIG. 4*a*-4*d* show the retraction process of the carrier in two subsequent positions, and enlarged detail views thereof.
Figure 4B:
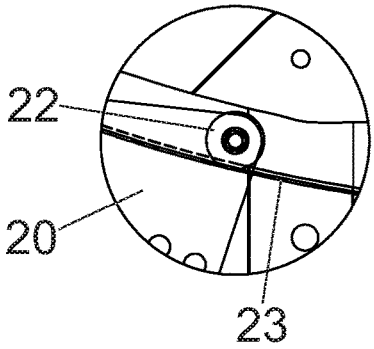
Figure 4C:
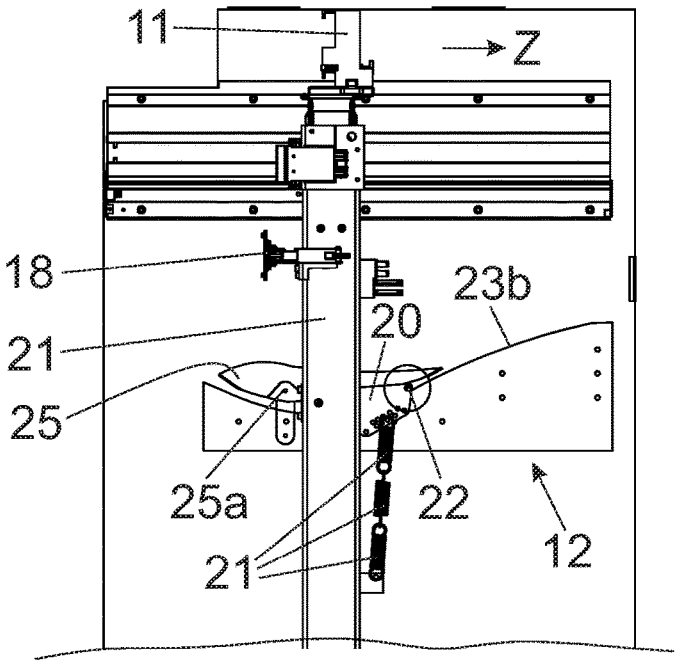
Figure 4D:
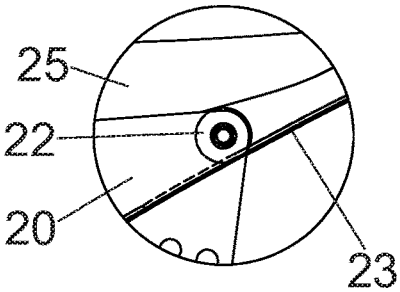

FIG. 4*a* shows a continued movement of the column 14 (and therewith of the carrier 11) in the direction (Z). Due to the reducing distance between the control curve 23 in the retraction section 23*a* (FIG. 3*a*) in relation to the bearing portion 24, the force storage members 21 are relaxed and thereby pull the column 14 and the carrier 11 in the direction (Z). FIG. 4*b* shows the region encircled in FIG. 4*a* in an enlarged view. When the pressure roller 22 reaches the lowest region of the control curve 23, the pressure roller 22 is moved to the tensioning section 23*b* of the control curve 23 by applying a manual force to the furniture parts 3*a*, 3*b*, so that the force storage members 21 are again tensioned and, as a result, can be loaded. The switch member 25 configured to be tilted about the pivoting axis 25*a* is thereby lifted by the pressure roller 22 (FIG. 4*c*), so that the pressure roller 22 can pass the switch member 25 in an unhindered manner upon a movement in the direction (Z) and can further be moved along the tensioning section 23*b*. Due to the eccentric arrangement of the switch member 25 about the pivoting axis 25*a*, a two-armed lever with lever arms of different lengths is formed, so that the switch member 25 with the longer lever arm loosely rests, preferably exclusively loaded by the force of gravity, against the tensioning section 23*b* of the control curve 23. If appropriate, the switch member 25 can also be pressed against the control curve 23 by a spring element. FIG. 4*d* shows the region encircled in FIG. 4*c* in an enlarged view.

Figure 5A:
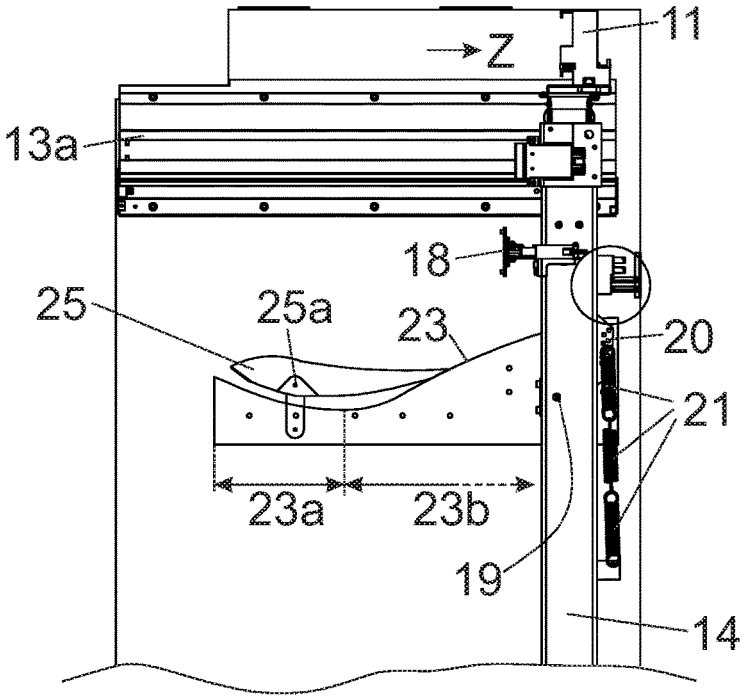
FIG. 5*a*-5*d* show continued positions of the carrier starting from FIG. 4*a*-4*d*, and enlarged detail views thereof.
Figure 5B:
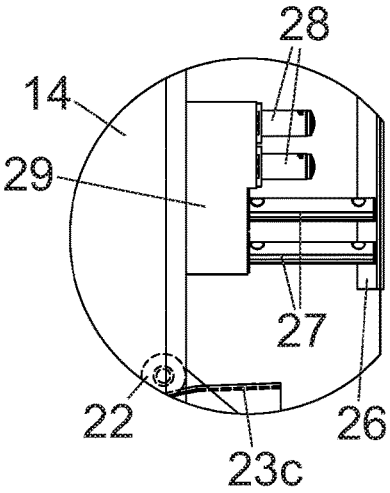

FIG. 5*a* shows the position of the column 14 right before reaching the fully inserted end position within the insertion compartment 7*a*. The pressure roller 22 has been moved along the tensioning section 23*b* of the control curve 23 and is located right before the horizontally extending end section 23*c* of the control curve 23, so that the column 14 is neither accelerated in the direction (Z) nor in a direction opposite the direction (Z). The force storage members 21 are thereby fully loaded. Arranged on the column 14 is a housing 29 in which a damping device 27 for dampening a closing movement of the column 14 and the carrier 11, respectively, is arranged. In the shown embodiment, the damping device 27 includes two, preferably hydraulic, linear dampers switched in a parallel relationship, and the linear dampers each have a piston-cylinder-unit. These linear dampers, at the end of the closing movement of the column 14, hit against a stationary abutment portion 26, whereby the rams of the linear dampers are pressed-in and therewith the movement of the column 14 can be decelerated. Moreover, two ejection devices 28 are arranged in the housing 29, the ejection devices 28 each have a lockable energy storage member, and the two rams of the ejection devices 28 are configured to cooperate with the abutment portion 26 upon a closing movement of the column 14, so that the energy storage members of the ejection devices 28 can be loaded and can be locked in a loaded condition. FIG. 5*b* shows the region encircled in FIG. 5*a* in an enlarged view.

Figure 5C:
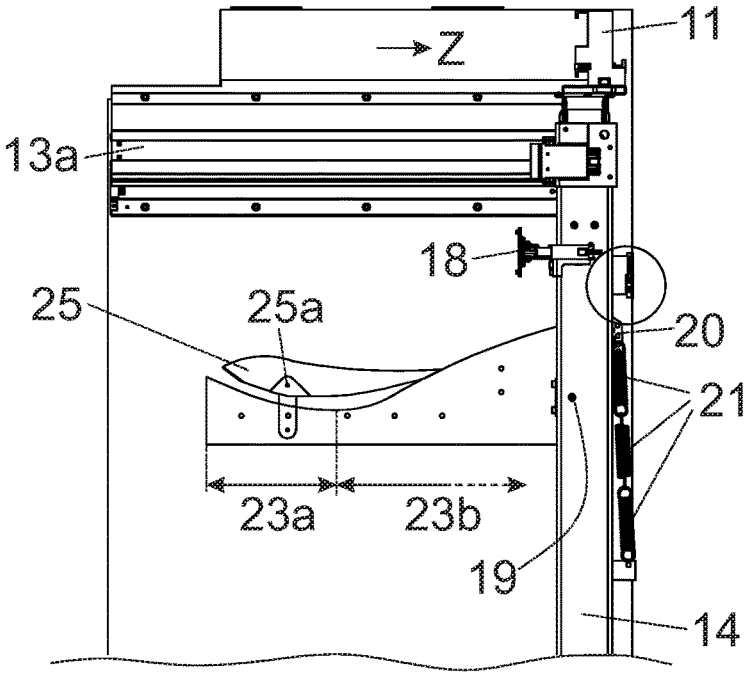
Figure 5D:
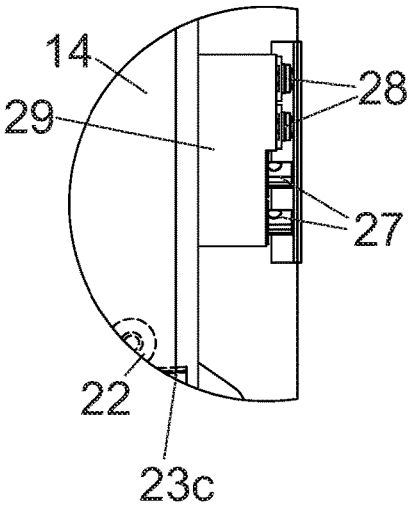

FIG. 5*c* shows the end position of the column 14, in which the last closing movement of the column 14 has been decelerated by the damping device 27 and the lockable energy storage members of the ejection devices 28 are in a loaded condition. By overpressing the column 14, starting from its closed position into an overpressing position lying behind the closed position, the ejection devices 28 can be moved into an unlocking position, whereupon the column 14 can be again moved by the force of the ejection devices 28 and, subsequently, by the force of the loaded force storage members 21 in a direction opposite the direction (Z). FIG. 5*d* shows the region encircled in FIG. 5*c* in an enlarged view.

Figure 6A:
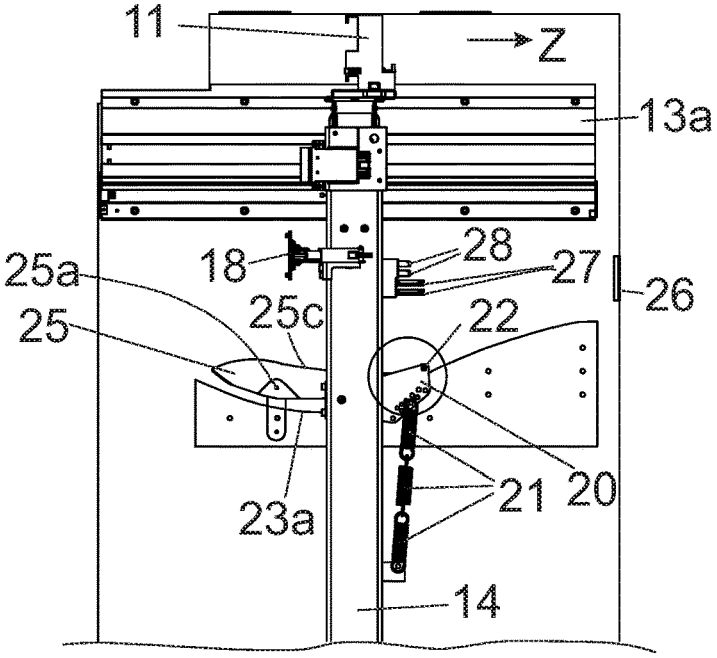
FIG. 6*a*-6*d* show the ejection process in two subsequent positions, and enlarged detail views thereof.
Figure 6B:
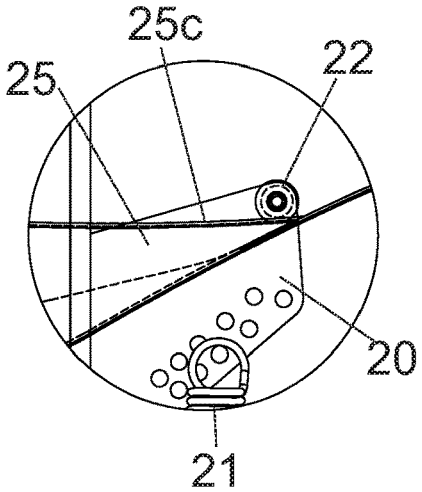

FIG. 6*a* shows a position of the column 14, after ejection of the ejection devices 28 in a direction opposite the direction (Z) has been performed. The pressure roller 22 is thereby located in a position entering the switch member 25, and the pressure roller 22, upon a movement in a direction opposite the direction (Z), is configured to be displaced no longer along the retraction section 23*a*, but along the setting contour 25*c* arranged or formed on the switch member 25. In this way, a uniformly-extending ejection operation of the column 14 and of the furniture parts 3*a*, 3*b*, respectively, can be brought about, without substantial oscillations in the force of the force storage members 21, and a force of the force storage members 21 can be maintained over a longer displacement path. FIG. 6*b* shows the region encircled in FIG. 6*a* in an enlarged view, in which the pressure roller 22 moves onto the setting contour 25*c* of the switch member 25 upon a movement of the column 14 in a direction opposite the direction (Z), without the pressure roller 22 needing to be displaced along the trough portion of the retraction section 23*a*.

Figure 6C:
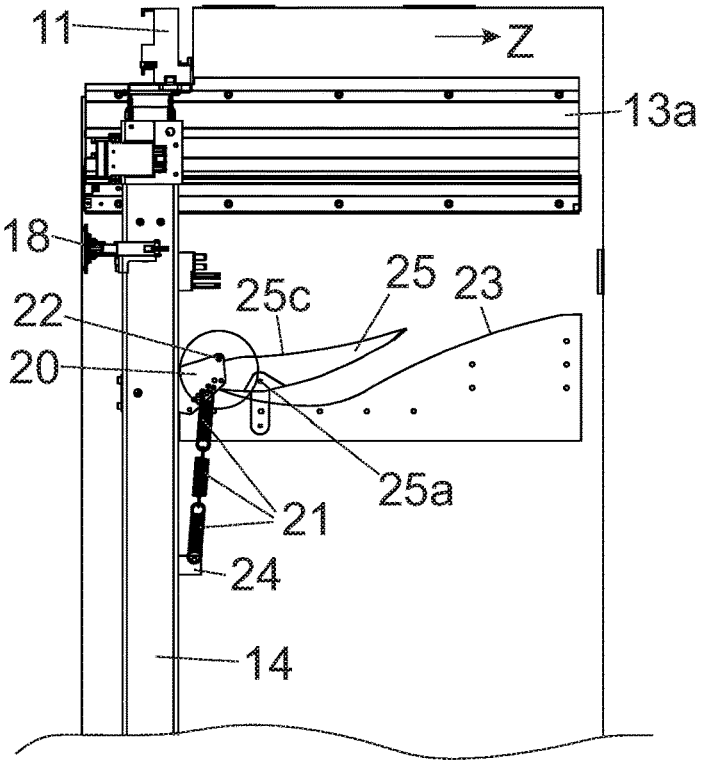
Figure 6D:
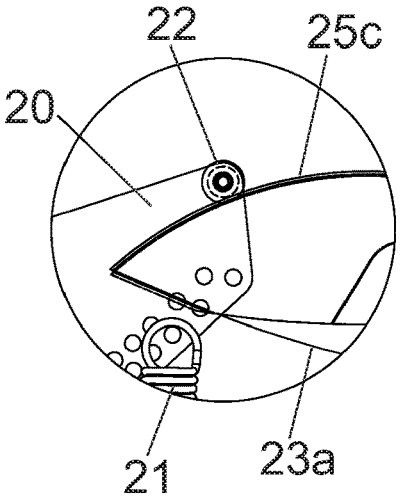

FIG. 6*c* shows a continued movement of the column 14 in a direction opposite the direction (Z), in which the pressure roller 22 has been moved along the setting contour 25*c* of the switch member 25 and in which the switch member 25 has been pivoted about the pivoting axis 25*a* in a counterclockwise direction. By this pivoting movement of the switch member 25 about the pivoting axis 25*a*, the pressure roller 22 is again returned to the initial region of the retraction section 23*a*. After the pressure roller 22 has abandoned the setting contour 25*c* of the switch member 25, the switch member 25 pivots about the pivoting axis 25*a* into its initial position, i.e. in that position in which the longer lever arm of the switch member 25, in turn, rests against the control curve 23 due to its heavier weight.

Figure 7A:
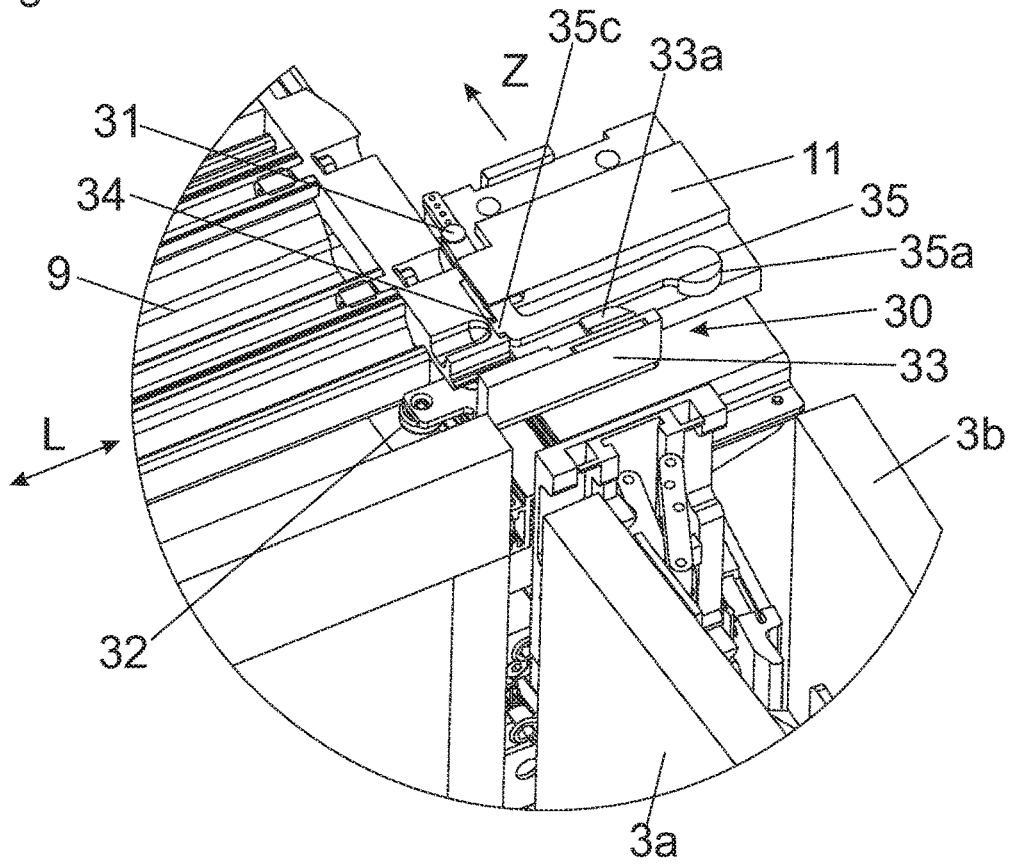
FIG. 7*a*, 7*b* show a possible embodiment for releasably locking between the carrier and the guide rail in two subsequent positions.
Figure 7B:
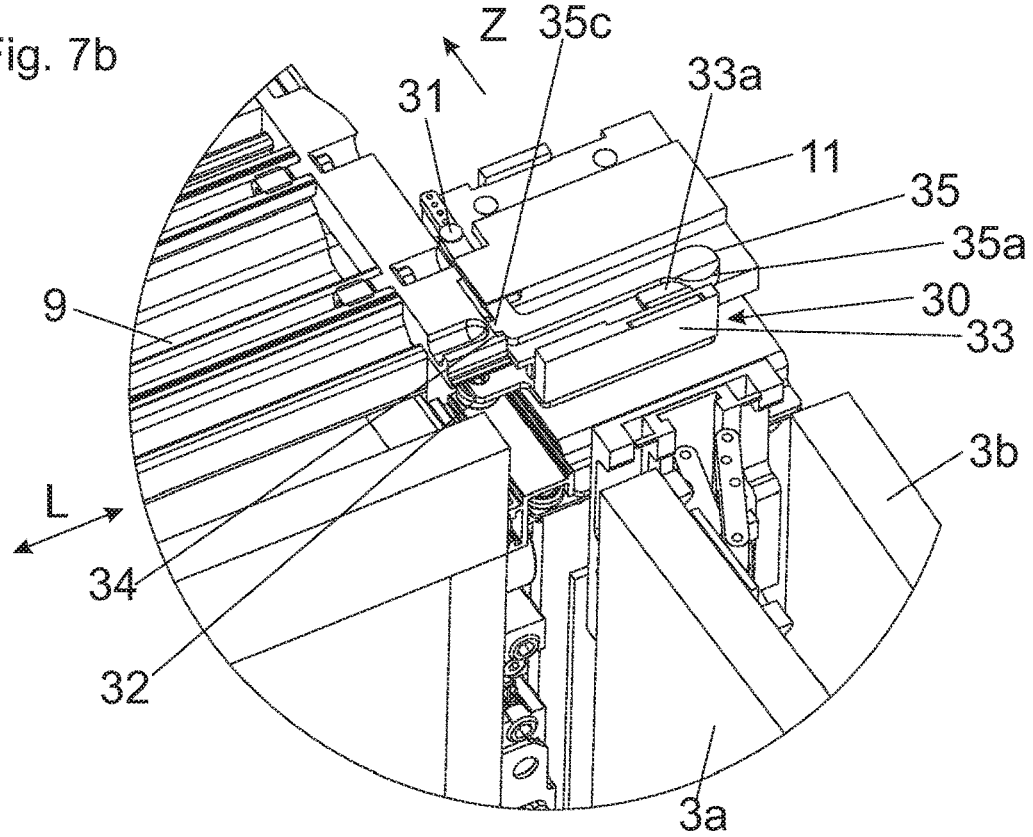

FIG. 7*a* and FIG. 7*b* show a possible embodiment of a locking device 30 for locking the carrier 11, in the transfer position or in a parking position, to the first guide rail 9, and the locking device 30 can be unlocked by a movement of the guiding device 10 in or on the carrier 11. The first furniture part 3*a* is connected to the guiding device 10 configured to be moved in the longitudinal direction (L) along the first guide rail 9. A displacement piece 33 is motionally coupled to the guiding device 10, so that upon a movement of the guiding device 10 along the first guide rail 9, the displacement piece 33 also moves therewith. The displacement piece 33 has a protrusion 33*a* which, upon a movement in or on the carrier 11, is configured to cooperate with a counterstop 35*a* of a coupling lever 35 (FIG. 7*b*). The coupling lever 35 is pivotally mounted about a pivoting axis 31, and a locking element 35*c* can be moved by the coupling lever 35. The locking element 35*c* engages into a corresponding recess 34 of the first guide rail 9 in the locking position and thereby locks the carrier 11 relative to the first guide rail 9. The coupling lever 35, together with the locking element 35*c*, can have a one-piece configuration. The coupling lever 35 can be prestressed in a direction of the locking position by a spring (not shown), so that the carrier 11, upon a movement of the carrier 11 in a direction opposite the direction (Z), can be automatically locked by a force of that spring to the first guide rail 9, and that the guiding device 10 can be again transferred back, starting from the carrier 11 to the first guide rail 9.

Figure 8A:
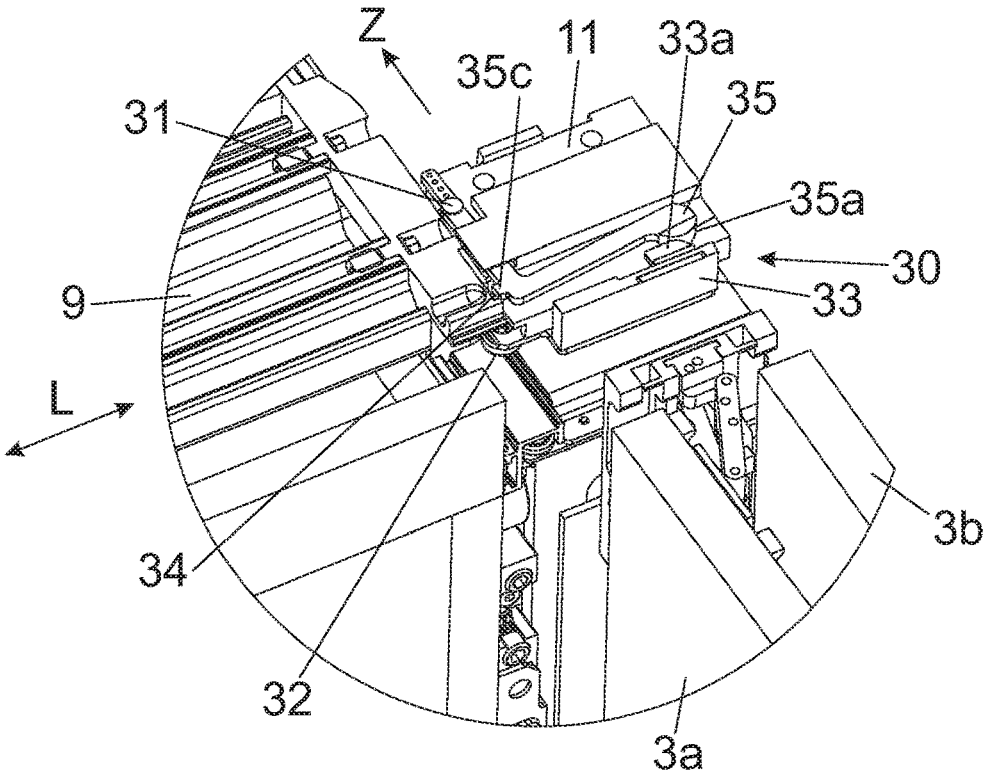
FIG. 8*a*, 8*b* show continued positions starting from FIG. 7*a*, 7*b*, FIG. 9*a*, 9*b* show an item of furniture with the movable furniture parts in a first position and in a second position.
Figure 8B:
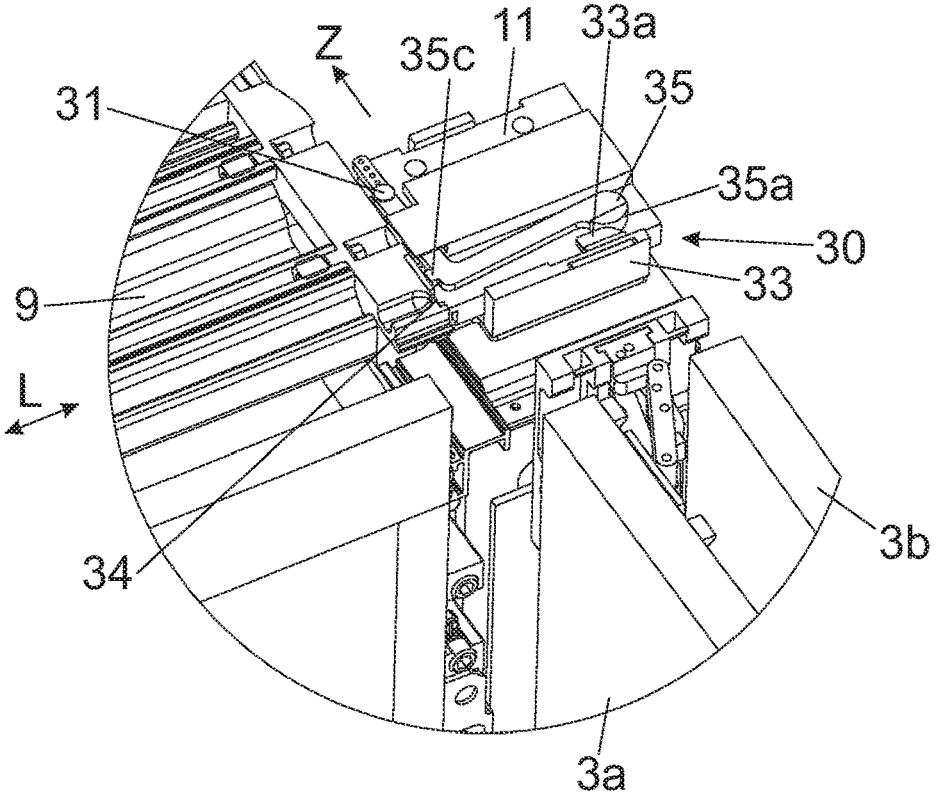

FIG. 8*a* and FIG. 8*b* show a continued movement of the displacement piece 33 motionally coupled to the guiding device 10 in the longitudinal direction (L), in which the protrusion 33*a* of the displacement piece 33 cooperates with the counterstop 35*a* of the coupling lever 35, and therewith pivots the coupling lever 35 about the pivoting axis 31. As a result, the locking element 35*c* is moved out from the recess 34 of the first guide rail 9 and the carrier 11 is released relative to the first guide rail 9 to enable a movement in the direction (Z). After unlocking has been effected, the carrier 11—together with the column 14—can be retracted at least partially in the direction (Z) by a force of the force storage members 21 of the above-described drive device 12, and a spacing roller 32 pivotally mounted to the displacement piece 33 for laterally guiding the carrier 11 in a the direction (Z) is configured to run along the side wall 8*a*.

Figure 9A:
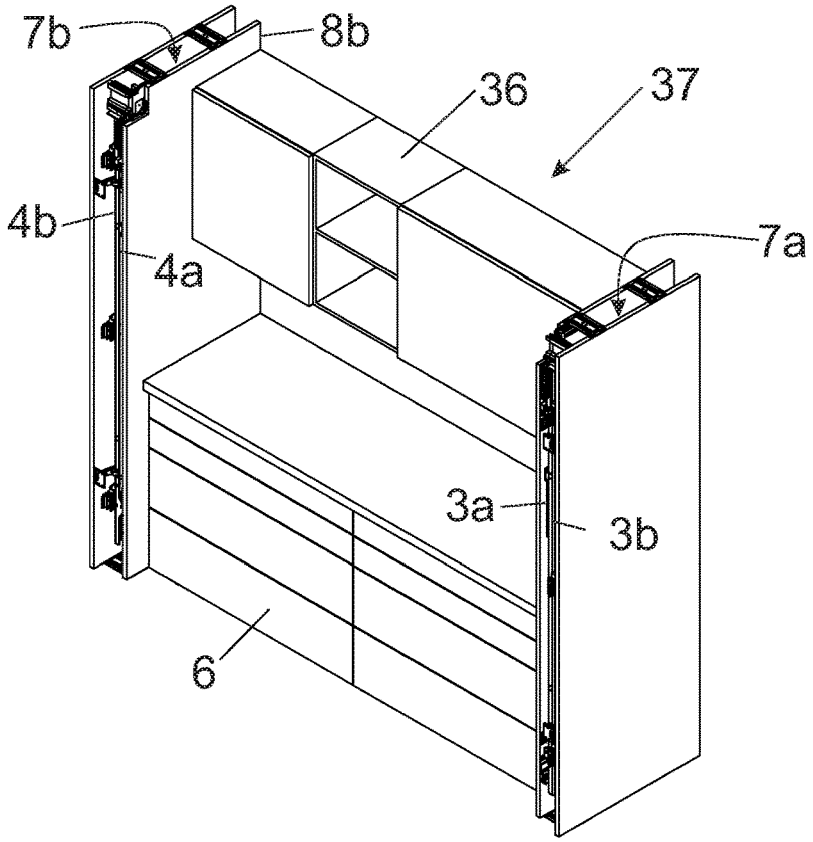
Figure 9B:
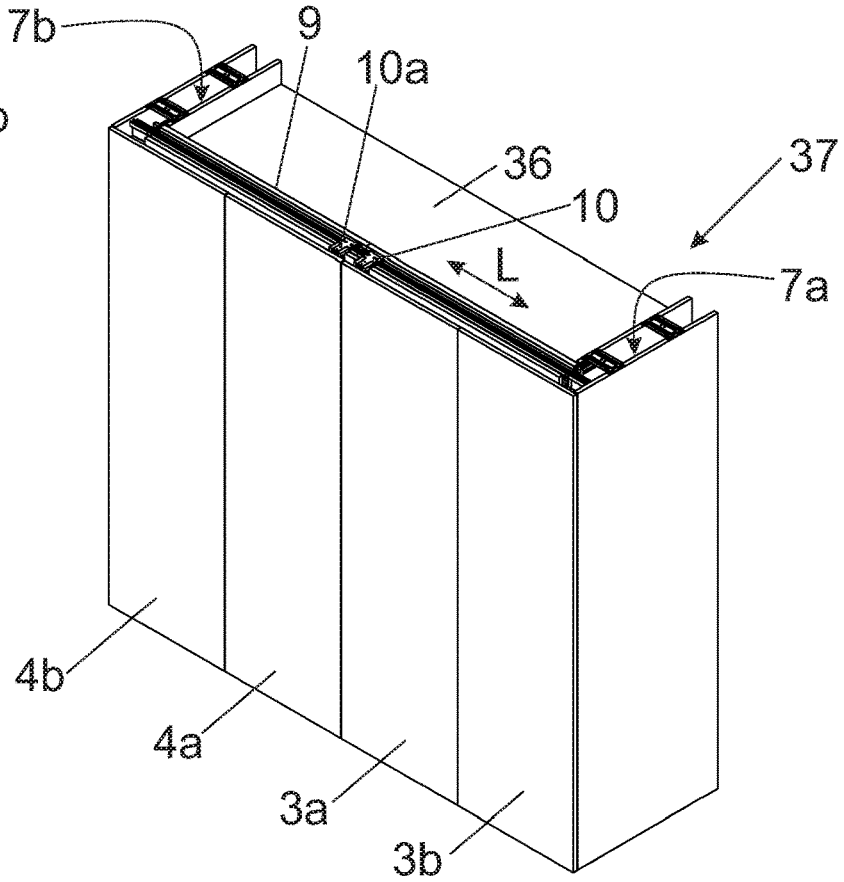

FIG. 9*a* and FIG. 9*b* show an item of furniture 37 according to FIG. 1*a*. The item of furniture 37 includes a first furniture carcass 36 being stationary during operation and at least two furniture parts 3*a*, 3*b*, in particular door wings of a folding door, movably-mounted relative to the furniture carcass 36. The furniture parts 3*a*, 3*b*, in the mounted position, are hingedly connected to one another by a vertically extending pivoting axis 5*a*. The at least two furniture parts 3*a*, 3*b* are capable of being moved by the guide system 2 between a first position, in which the furniture parts 3*a*, 3*b* are aligned substantially coplanar to each other (FIG. 9*b*), and a second position, in which the furniture parts 3*a*, 3*b* are aligned substantially parallel to each other (FIG. 9*a*). The item of furniture 37 can have at least one lateral insertion compartment 7*a*, 7*b* in which the furniture parts 3*a*, 3*b* can be accommodated in the second position. In the shown figure, at least one further (second) furniture carcass 6 is provided which is inserted into the furniture carcass 36 or which is connected to the furniture carcass 36, and the further furniture carcass 6 can be covered by the movable furniture parts 3*a*, 3*b*, 4*a*, 4*b* in the first position and is accessible in the second position. The furniture parts 3*a*, 3*b* can be displaced relative to the first guide rail 9 by the guiding device 10, while the furniture parts 4*a*, 4*b* are movable along the same first guide rail 9 by a separate guiding device 10*a*.

Figure 10A:
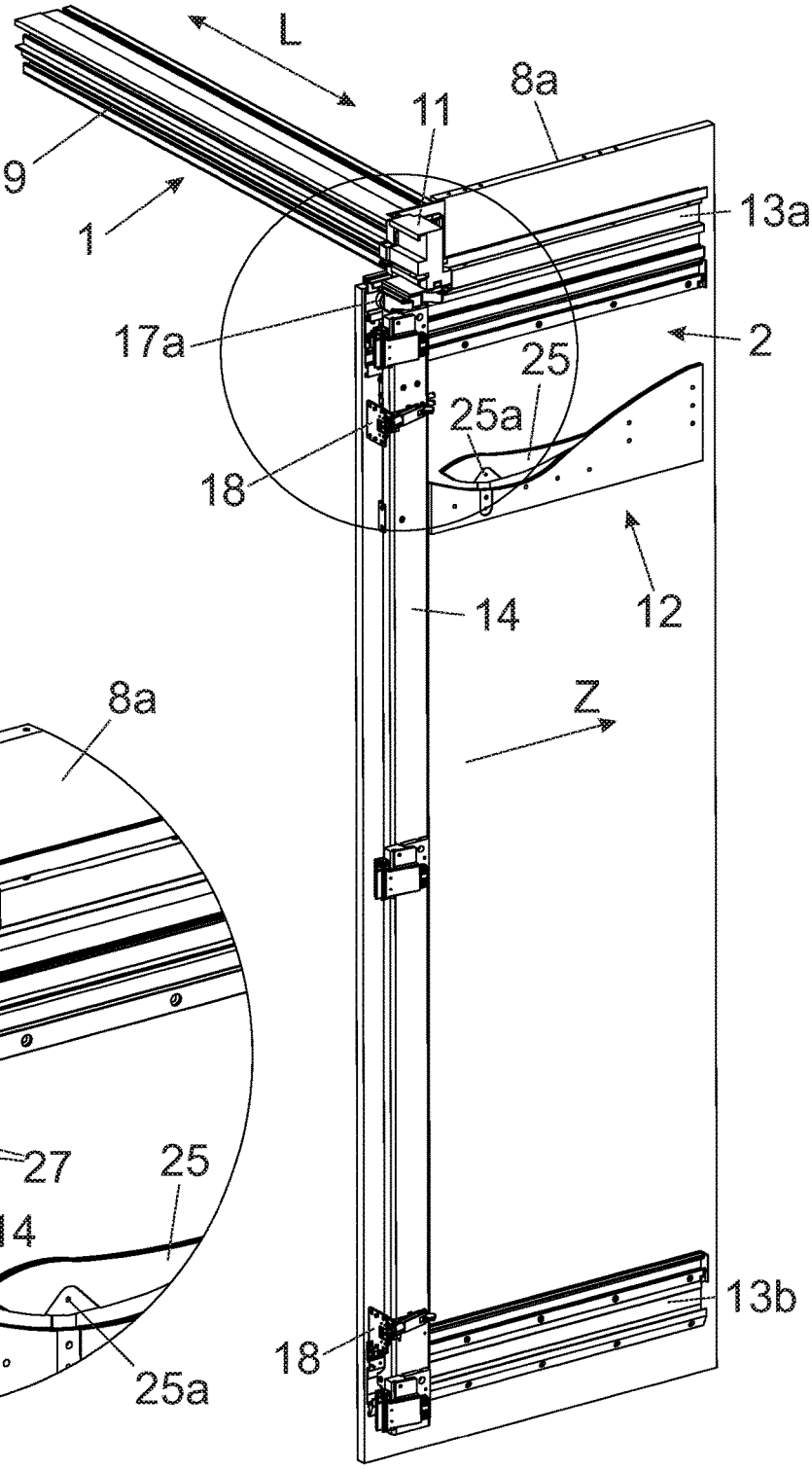
FIG. 10*a*, 10*b* show the guide system with the carrier in a first position, and an enlarged detail view thereof.

FIG. 10*a* shows the rail arrangement 1 of the guide system 2, in which the carrier 11 can be locked to the first guide rail 9 by the described locking device 30, and the carrier 11 can be moved from the transfer position in a direction (Z) extending transversely to the longitudinal direction (L). On the side wall 8*a*, which can partially form the insertion compartment 7*a*, second guide rails 13*a* and 13*b* are fixed which are provided for the displaceable support of the column 14 connected to the carrier 11, and fixed to the side wall 8*a* is the drive device 12 with the switch 25 pivotally mounted about the pivoting axis 25*a*.

Figure 10B:
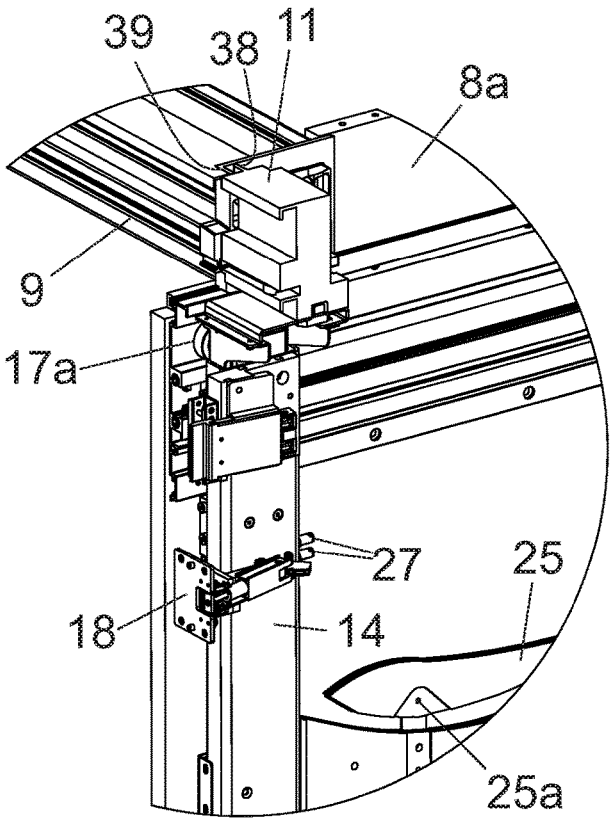

FIG. 10*b* shows the region encircled in FIG. 10*a* in an enlarged view, in which the carrier 11 has been moved out from the transfer position and has slightly been moved in the direction (Z). For limiting a movement of the carrier 11 in a direction opposite the direction (Z), at least one abutment element 38 is provided on the carrier 11. The abutment element 38 is configured to hit against a counterstop 39 of the first guide rail 9, whereby a further movement of the carrier 11 in a direction opposite the direction (Z) is prevented. For guiding the carrier 11 and the column 14, respectively, at least one supporting roller 17*a* can be provided which is configured to run along a running limb arranged or formed on the second guide rail 13*a*. Visible is the damping device 27 arranged on the column 14, the damping device 27 being provided for dampening a movement of the column 14 within an end region being remote from the transfer position.

Figure 11A:
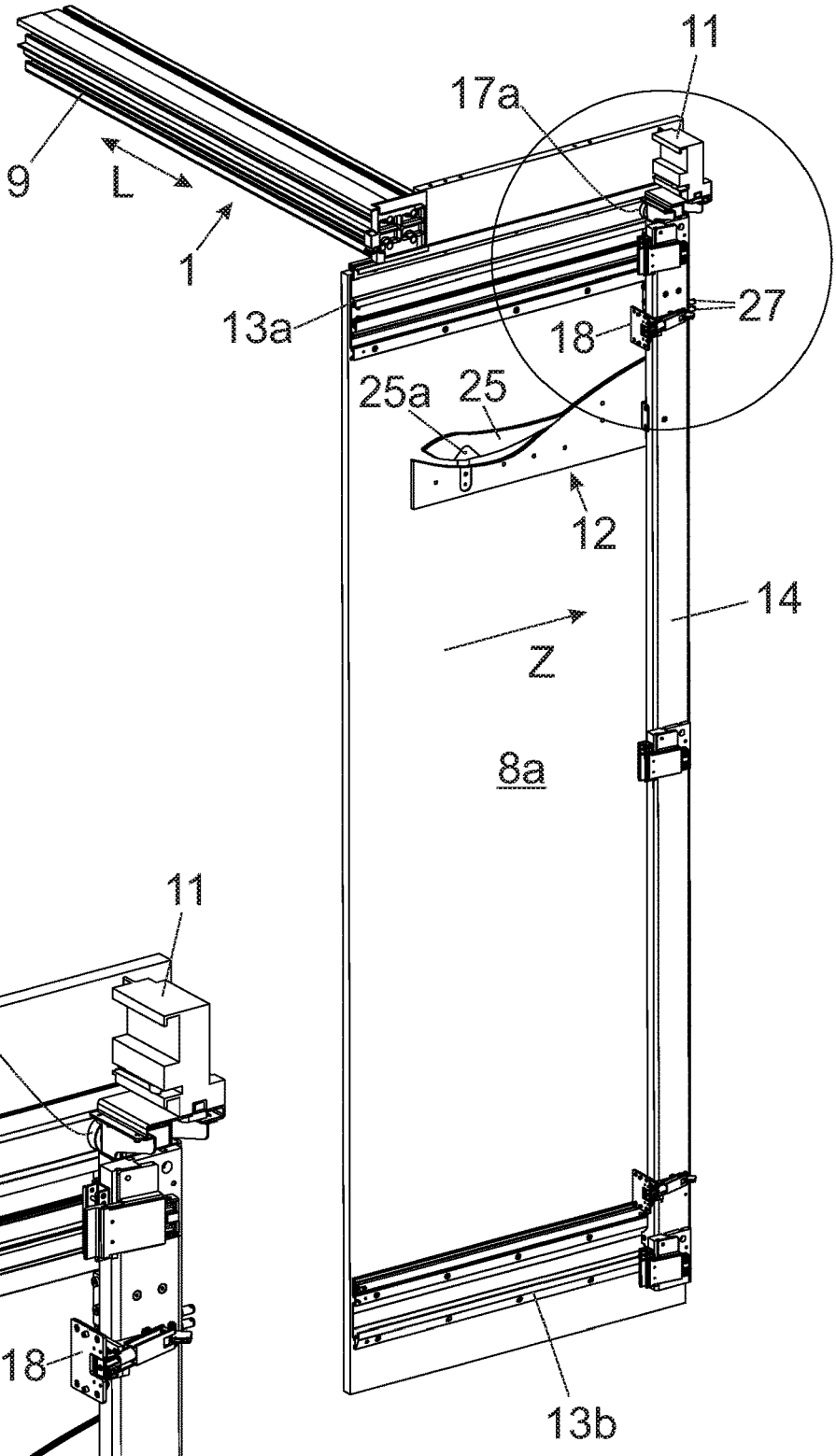
FIG. 11*a*, 11*b* show the guide system with the carrier in a second position, and an enlarged detail view thereof.
Figure 11B:
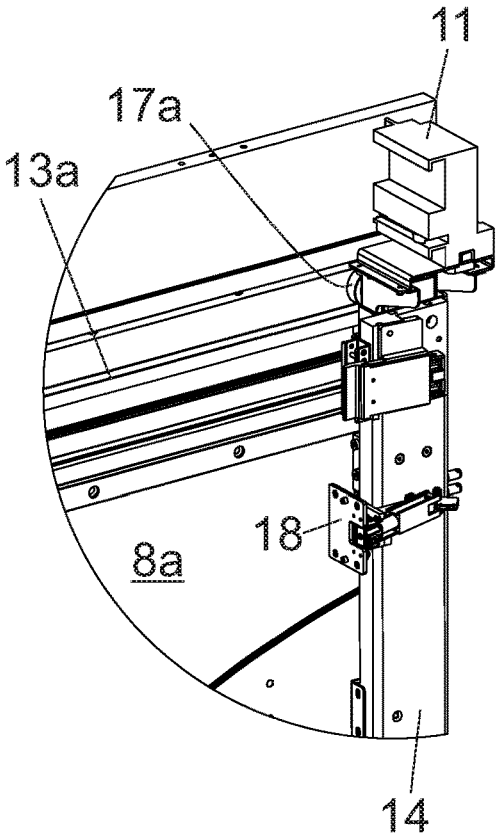

FIG. 11*a* shows the carrier 11 in a position remote from the first guide rail 9 corresponding to a position of the furniture parts 3*a*, 3*b* when fully inserted into the insertion compartment 7*a*. Starting from the position shown in FIG. 11*a*, the furniture parts 3*a*, 3*b* can be moved in a direction opposite the direction (Z) by the ejection devices 28 (not shown here). FIG. 11*b* shows the region encircled in FIG. 11*a* in an enlarged view.

Figure 12A:
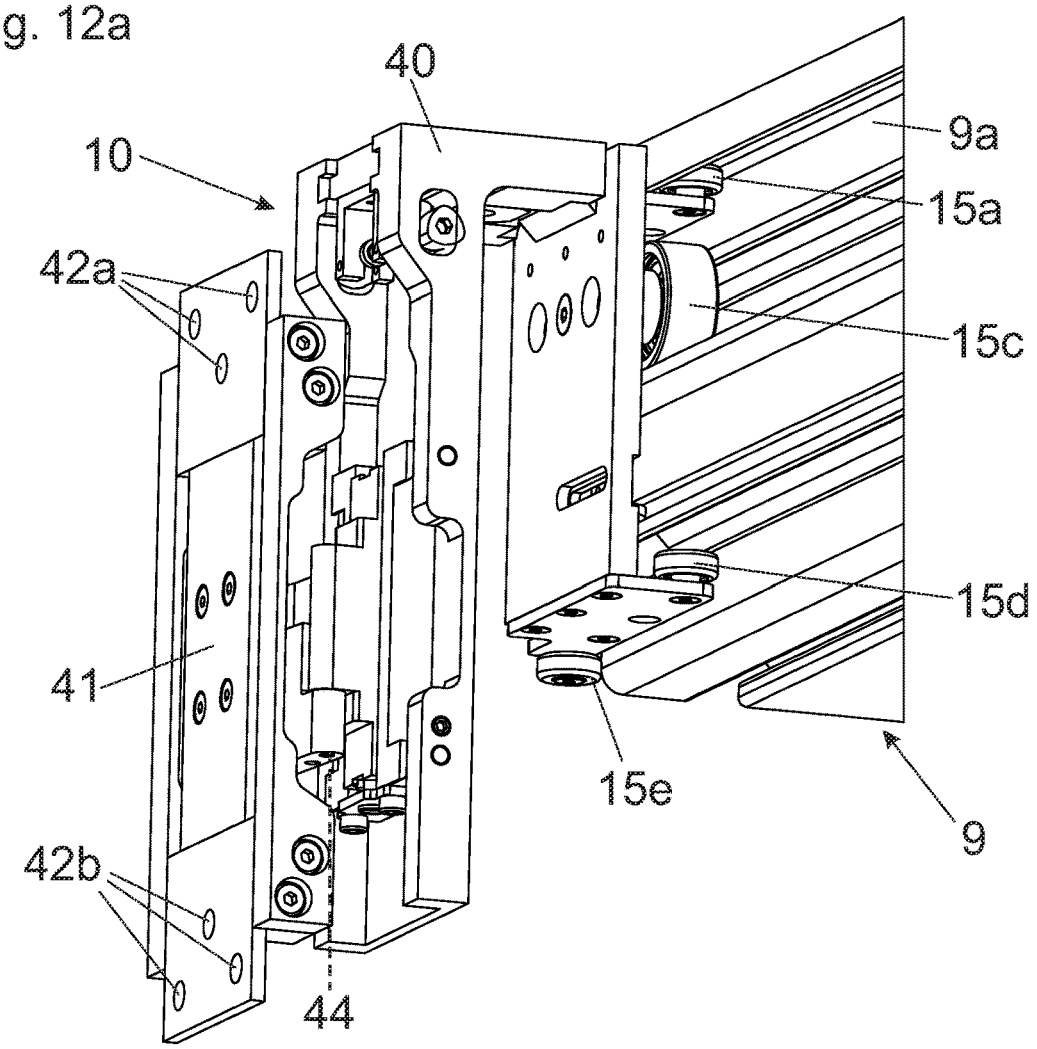
FIG. 12*a*, 12*b* show the guiding device movably-supported on the guide rail in a perspective view and in a cross-sectional view.

FIG. 12*a* shows a perspective view of the guiding device 10 configured to be movably supported on the first guide rail 9. The guiding device 10 can include a plurality of running wheels 15*a*, 15*c*, 15*d*, 15*e* with vertically and with horizontally extending rotational axes, and the running wheels 15*a*, 15*c*, 15*d*, 15*e* are configured to run along a profiled section 9*a* of the first guide rail 9. The guiding device 10 has a holding arm 40, and the fitting portion 41 to be fixed to the furniture part 3*a* is connected to the holding arm 40 by a vertically extending pivoting axis in the mounting position. The fitting portion 41 includes a plurality of fastening locations 42*a*, 42*b* for fixing to the furniture part 3*a*.

Figure 12B:
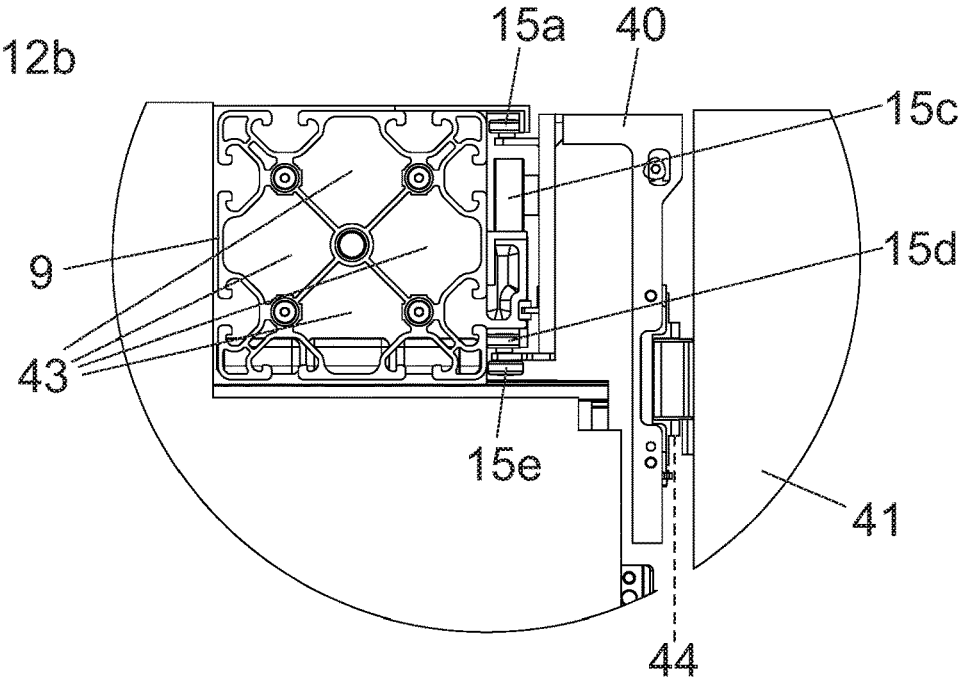

FIG. 12*b* shows a cross-sectional view of the guiding device 10 configured to be movably supported on the first guide rail 9. The first guide rail 9, in a cross-section, has a plurality of cavities 43 which are separated from each other by profiled limbs. The running wheels 15*a*, 15*c*, 15*d*, 15*e* are configured to run along the first guide rail 9, and the fitting portion 41 configured to be fixed to the furniture part 3*a* is pivotally connected to the holding arm 40 by the vertically extending pivoting axis 44.

LIST OF REFERENCE NUMBERS

1 rail arrangement
2 guide system
3*a*, 3*b* furniture parts
4*a*, 4*b* furniture parts
5*a*, 5*b* vertical pivoting axes,
6 furniture carcass
7*a*, 7*b* insertion compartments
8*a*, 8*b* side walls
9 first guide rail
9*a* profiled section of first guide rail
10 guiding device
11 carrier
11*a* profiled section of carrier
12 drive device
13*a*, 13*b* second guide rails
14 column
15*a*, 15*b*, 15*c*, 15*d*, 15*e* running wheels
16*a*, 16*b* guide channels
17*a*, 17*b* supporting rollers
18 fitting portion
19 pivoting axis of entrainment member
20 entrainment member
21 force storage members
22 pressure roller
23 control curve
23*a* retraction section of control curve
23*b* tensioning section of control curve
23*c* end section of control curve
24 bearing portion
25 switch member
25*a* pivoting axis of switch member
25*c* setting contour of switch member
26 stationary abutment portion
27 damping device
28 ejection devices
29 housing
30 locking device
31 pivoting axis of coupling lever
32 spacing roller
33 displacement piece
33*a* protrusion of displacement piece
34 recess of first guide rail
35 coupling lever
35*a* counterstop of coupling lever
35*c* locking element of coupling lever
36 furniture carcass
37 item of furniture
38 abutment element of carrier
39 counterstop of first guide rail
40 holding arm of guiding device
41 fitting portion of guiding device
42*a*, 42*b* fastening locations of guiding device
43 cavities of first guide rail
44 pivoting axis of fitting portion

The invention claimed is:

1. A guide system for guiding a movably-supported first furniture part hingedly connected to a second furniture part, the guide system comprising:

a guide rail for guiding the furniture parts along a longitudinal axis of the guide rail;

a guiding device configured to be connected to a first one of the furniture parts and configured to be movable along the guide rail;

a carrier movably mounted in a direction transverse to the longitudinal axis of the guide rail, the carrier being configured to be moved into a transfer position at which the carrier adjoins the guide rail on the longitudinal axis such that the guiding device is movable along the guide rail and is transferable to and from between the guide rail and the carrier;

a column connected to the carrier, the column being arranged vertically in the mounting position and being configured to be moved, together with the carrier, in the direction extending transversely to the longitudinal axis of the guide rail, the second furniture part to be movably connected to the column; and a drive device including:

a force storage member;

an entrainment member to be acted upon by the force storage member and to be releasably coupled to the guiding device; and a locking device configured to lock the entrainment member in the transfer position of the carrier, wherein the entrainment member is configured to be unlocked from the locking device by a movement of the guiding device into or onto the carrier such that the entrainment member with the guiding device coupled therewith is retractable by the force storage member starting from the transfer position over a distance in a direction (Z) extending transversely to the longitudinal axis of the guide rail.

2. The guide system according to claim 1, wherein the carrier is configured to be lockable to the guide rail by the locking device in the transfer position, the locking device being unlockable the movement of the guiding device into or onto the carrier.

3. The guide system according to claim 1, wherein the guide rail includes a profiled section for guiding the guiding device, the profiled section extending over at least a portion of the longitudinal axis of the guide rail.

4. The guide system according to claim 3, wherein the profiled section of the guide rail has a cross-sectional form and size corresponding to a cross-sectional form and size of a profiled section of the carrier.

5. The guide system according to claim 1, wherein the guiding device is configured as a slider having a running wheel configured to run along the guide rail.

6. The guide system according to claim 5, wherein the running wheel is a first running wheel having a horizontally extending rotational axis, and the slider having a second running wheel having a vertically extending rotational axis.

7. The guide system according to claim 1, wherein the guide rail is a first guide rail, the guide system further comprising a second guide rail configured to be mounted along a direction extending transversely to the longitudinal axis of the guide rail, the carrier being configured to run along the second guide rail.

8. The guide system according to claim 7, wherein the first guide rail extending along the longitudinal axis and the second guide rail extending in the direction transversely to the longitudinal axis are spaced apart from each other in a height direction.

9. The guide system according to claim 1, wherein the column has a fitting portion for movably supporting a furniture part.

10. The guide system according to claim 1, wherein the entrainment member with the guiding device coupled therewith is retractable by the force storage member in the direction extending transversely to the longitudinal axis of the guide rail along a second guide rail.

11. The guide system according to claim 1, further comprising an ejection device for moving the carrier starting from an end position in a direction towards the transfer position and opposite the direction extending transversely to the longitudinal axis of the guide rail.

12. An item of furniture comprising the guide system according to claim 1.

13. The item of furniture according to claim 12, further comprising:

a furniture carcass to be stationary during operation; and at least two furniture parts hingedly connected to one another by a vertically extending pivoting axis, wherein the at least two furniture parts are configured to be moved by the guide system between a first position, in which the furniture parts are aligned substantially coplanar to each other, and a second position, in which the furniture parts are aligned substantially parallel to each other.

14. The item of furniture according to claim 13, further comprising a lateral insertion compartment for accommodating the furniture parts in the second position.

15. The item of furniture according to claim 13, wherein the furniture carcass is a first furniture carcass, the item of furniture further comprising a second furniture carcass inserted into or connected to the first furniture carcass, and the second furniture carcass being covered by the furniture parts in the first position and being accessible in the second position.

16. The guide system according to claim 7, wherein the carrier is configured to run along the second guide rail by a supporting roller.

17. The guide system according to claim 1, wherein the carrier is releasably lockable with the guide rail in the transfer position.

18. The item of furniture according to claim 13, wherein the furniture parts are door wings of a folding door, and are movably-mounted relative to the furniture carcass.

* * * * *